US006846177B1

(12) United States Patent
Hutchens

(10) Patent No.: US 6,846,177 B1
(45) Date of Patent: Jan. 25, 2005

(54) METHOD AND APPARATUS FOR FACILITATING A TOBACCO CURING PROCESS

(76) Inventor: Thomas W. Hutchens, 101 Rickard Ln., Winchester, KY (US) 40391

( * ) Notice: Subject to any disclaimer, the term of this patent is extended or adjusted under 35 U.S.C. 154(b) by 0 days.

(21) Appl. No.: 10/726,170

(22) Filed: Dec. 2, 2003

(51) Int. Cl.[7] ..... A24B 1/02
(52) U.S. Cl. ..... 432/500; 131/290
(58) Field of Search ..... 432/500; 34/209, 34/210, 212, 215; 131/290

(56) References Cited

U.S. PATENT DOCUMENTS

| | | | | | |
|---|---|---|---|---|---|
| 646,218 | A | * | 3/1900 | Hollingsworth | 131/302 |
| 2,534,618 | A | | 12/1950 | Moore, Jr. | |
| 2,989,057 | A | | 6/1961 | Touton | |
| 3,024,792 | A | | 3/1962 | Touton | |
| 3,202,157 | A | | 8/1965 | Touton | |
| 3,231,986 | A | | 2/1966 | Touton | |
| 3,251,620 | A | | 5/1966 | Hassler | |
| 3,664,034 | A | * | 5/1972 | Wilson | 34/225 |
| 3,866,334 | A | | 2/1975 | Huang | |
| 3,935,648 | A | | 2/1976 | Cox | |
| 4,011,041 | A | | 3/1977 | Taylor | |
| 4,069,593 | A | * | 1/1978 | Huang | 34/93 |
| 4,079,546 | A | | 3/1978 | Huang | |
| 4,156,974 | A | * | 6/1979 | Huang | 34/236 |
| 4,184,706 | A | | 1/1980 | Simmons | |
| 4,192,323 | A | | 3/1980 | Horne | |
| 4,263,721 | A | | 4/1981 | Danford | |
| 4,383,538 | A | | 5/1983 | Beard et al. | |
| 4,424,024 | A | | 1/1984 | Wilson et al. | |
| 5,163,454 | A | | 11/1992 | Clemons | |
| 5,685,710 | A | | 11/1997 | Sagrera et al. | |
| 6,438,862 | B1 | | 8/2002 | Soucy | |

* cited by examiner

*Primary Examiner*—Gregory Wilson
(74) *Attorney, Agent, or Firm*—Stoll, Keenon & Park, LLP

(57) ABSTRACT

Apparatus and method for facilitating a tobacco curing process, with the apparatus being for use in a tobacco barn, with the tobacco barn having a plurality of internal cross members for supporting tobacco leaves during curing. The apparatus includes a plenum for attachment to a tobacco barn; a device for generating air movement in fluid communication with the plenum for delivering atmospheric air thereto; and a plurality of conduits in fluid communication with the plenum for receiving airflow therefrom, the conduits being formed with a plurality of openings therein to allow air to flow outwardly therefrom, the conduits being configured for disposition within the barn for fluid communication with tobacco in a curing disposition within the barn.

33 Claims, 4 Drawing Sheets

METHOD AND APPARATUS FOR FACILITATING A TOBACCO CURING PROCESS

BACKGROUND OF THE INVENTION

The present invention relates broadly to tobacco curing methods and associated apparatus and, more particularly, to an apparatus and method for facilitating a process for curing tobacco and providing an associated apparatus for controlling air circulation.

Globally, people smoke fifteen billion cigarettes everyday, with United States accounting for approximately one billion cigarettes consumed each day.

The two leading tobacco-producing states are Kentucky and North Carolina with North Carolina producing primarily flue-cured bright leaf tobacco while Kentucky produces primarily air-cured burley tobacco. The western mountains of North Carolina also produce burley tobacco.

Nearly half of all tobacco farms are located in Kentucky where the annual tobacco crop has averaged more than eight hundred million dollars during the decade of the 1990's. Tobacco currently accounts for around fifty percent of Kentucky's crop receipts and twenty five percent of Kentucky's total agricultural cash receipts, yet tobacco uses one percent of the farmland in Kentucky. An acre of tobacco averages around four thousand dollars in gross returns at the farm level while contributing around forty thousand dollars in federal, state and local tax revenue as a result of excise taxes on tobacco products. Average yields are about 2,500 pounds per acre and the plants are stalk cut. The leaves are stripped after curing. In addition to Kentucky, burley tobacco is produced in Tennessee, Ohio, Virginia, North Carolina, West Virginia and Missouri, with Kentucky and Western North Carolina accounting for the majority of burley produced. Accordingly, tobacco has a significant economic impact on these states.

Burley tobacco is a light air-cured tobacco and accounts for about eleven percent of world production. Cured burley leaf is characterized by low sugar content and a very low sugar-to-nitrogen ratio. The low sugar-to-nitrogen ration may be enhanced by using high nitrogen fertilizer, harvesting at an early stage of senescence, and through the air-curing process that allows oxidation of any sugars which may have occurred.

Another feature of burley tobacco is its significant capacity to absorb flavorings. Burley can typically absorb twenty five percent of its own weight in flavorings in contrast to about seven or eight percent for flue-cured tobacco.

The cured burley leaves vary in color from light tan to red and brown and the leaf should be without yellow patches or fringes. The burley leaves are slightly larger than flue-cured leaves and the burley plants are generally taller. A typical burley plant is topped at 20–30 leaves.

As is generally known, tobacco must be cured before it is used to manufacture cigarettes, or other tobacco products. Curing is the process that brings about the rapid destruction of chlorophyll, giving leaves their yellow appearance, converting sugar into starch and removing moisture. Curing brings out the aroma and flavor of each variety of tobacco. Before tobacco is cured, the leaves contain about 80 to 85 percent water which is essentially eliminated in the curing process. Among the factors that affect the curing process are growth soil, position of the leaf on the stalk and weather, including the environment within the curing barn.

Curing involves essentially three steps including yellowing, leaf drying and stem drying. The yellowing stage is a continuation of the ripening process and some say the most important part of the curing process. During yellowing, the leaf remains alive which allows it to carry on certain biological processes to convert sugar into starch and to break down chlorophyll. The stomata allows a continuous exchange of carbon dioxide, oxygen and water to the leaf. As the exchange evolves, yellow pigments become visible as chlorophyll breaks down.

When tobacco leaves are harvested, they are high in sugar and low in starch. As sugar decreases through the natural process of hydrolysis and respiration, the amount of starch increases. During the leaf drying stage, the leaf tissue is dried to predetermined moisture level. The stem drying stage is referred to as the killing stage because all moisture is removed from the stem and leaf, thereby killing them.

As stated above, burley tobacco is air-cured. Air-curing barns typically include an open framework including support members from which the whole stalk is hung and protected from wind and the sun. Barns may be equipped with ventilators that can be opened or closed to vary temperature and humidity to a limited extent.

A typical air-curing process takes six to eight weeks. Leaves turn from green to yellow as stems and leaves slowly dry. The leaves generally have a low sugar content and vary in nicotine content. Curing burley is not merely drying the leaf but is, in actuality, a six-to-eight week process that allows chemical changes to occur as the leaf dries. By varying temperature and humidity at the leaf, the quality of the product may be enhanced.

Good burley curing in a barn or field structure requires daily average humidity of about 65–75 percent to sustain enough leaf moisture for the necessary chemical changes to produce the desired tan and brown leaf colors. Cool fall temperatures below about 50 to 60 degrees are generally detrimental to good burley curing.

Consecutive days of higher or low humidity can also cause problems. For example, humidity above about 80 percent for three consecutive days in a warm environment can allow bacterial action to accelerate and cause rotting. Low humidity, i.e., below about 50 percent, for several days can desiccate the leaf moisture, stop chemical reactions and set undesirable green or yellow colors in the leaf. Therefore, control of airflow and humidity are important factors in controlling the curing process to provide commercial quality tobacco worthy of cigarette manufacture.

Dark air-cured tobacco accounts for about twenty percent of the world production and encompasses a number of types of tobacco used mainly for chewing, snuff, cigar and pipe blends. In the United States, dark air-cured tobacco is produced in Kentucky, Tennessee and Virginia. Three types are One-Sucker, Green River and Virginia sun-cured. This tobacco is characterized by heavy leaves. The plants are highly fertilized and topped low to around 10 to 12 leaves. Dark air-cured leaf is high in nicotine and is used in chewing and snuff and some pipe mixtures.

One-Sucker is the common name for a type of air-cured tobacco produced mainly in northern Tennessee, south central Kentucky and Indiana One-sucker dark air-cured tobacco is used in the manufacture of chewing tobacco. Green River is a type of dark air-cured tobacco produced principally in the Green River section of Kentucky around Owensboro and Henderson. It commonly used in chewing tobacco although to some extent it can be used for snuff and smoking tobaccos.

As stated above, bright leaf tobacco is flue-cured. Flue-cured tobacco is dried in a closed building with furnace-driven heat directed from flues or pipes that extend from a furnace into a barn. The temperature of the furnace is gradually raised until the leaves and stems are completely dried. For example, the temperature may be raised from 90 degrees Fahrenheit to 160 Fahrenheit. As the heat and humidity are controlled, moisture is removed, resulting in dried yellowed leaves and stems.

Flue-curing takes about a week and accounts for approximately fifty percent of the tobacco produced in the United States. Most flue-cured tobacco is used in the production of cigarettes and has a high sugar content and a medium-to-high nicotine content. Flue-cured tobacco is typically yellow to reddish-orange in color, thin to medium in body and mild in flavor.

Fire-cured tobacco is dried with low-burning wood fires on the floors of closed curing barns. The smoke is what gives fire-cured tobacco its smoky aroma and flavor. These leaves have a low sugar content but high nicotine content. Farmers regulate heat, humidity and ventilation in the curing barns. This process can be continuous or intermittent, extending from about three days to about ten weeks. Fire-cured tobacco is used to make cigarettes, chewing tobacco, snuff, and strong tasting cigars. Fire-cured tobacco is light-to-dark brown in color, medium-to-heavy in body and strong in flavor.

Of particular concern to tobacco producers and users are compounds known as tobacco-specific nitrosamines (TSNAs) which are carcinogenic. Some carcinogenic compounds that exist in tobacco smoke result from the combustion and pyrolysis of tobacco. Nitrosamines, on the other hand, are thought to be one of the only types of carcinogens that exist in both flue-cured and air-cured tobacco leaf.

Eight types of nitrosamines have been identified as tobacco-specific, seven of which have been reported as present in cigarette smoke. Since few nitrosamines are present in green tobacco leaf, the curing process plays a major role in the formation thereof. While it is not exactly clear how TSNAs form in air-cured burley, the current consensus is that bacteria or micro-flora convert nitrate to oxides of nitrogen that react with alkaloids to form TSNAs. Whether the reduction of TSNAs will have a significant effect on reducing the health risks of smokeless tobacco and cigarettes is not known. Nevertheless, reduction of nitrosamines through controlled curing environments can only have a positive effect on the tobacco product.

Due to the use of different curing methods throughout the world, the level of TSNAs in flue-cured tobacco varies. Most growers in the U.S., where flue-cured tobacco has some of the highest levels of TSNAs, use curing barns with direct-fired burners. In these barns, the exhaust gases of the burners are circulated through the barn, coming in contact with the tobacco. Combustion bi-products in the exhaust include oxides of nitrogen or NOx, which reacts with naturally occurring alkaloids in the tobacco to form TSNAs.

High TSNA tobacco is mainly a problem in the U.S., Canada, Australia and parts of Argentina where direct-fired curing is prevalent. Other major tobacco growing countries which typically have lower TSNA levels use heat exchanger-based curing, with either coal, wood or oil as their primary fuel. Heat exchanger curing excludes products of combustion from the curing air, reducing the likelihood of TSNA formation.

Direct-fired curing or fire-curing was not common in the U.S. until the late 1960s and early 1970s when the energy crisis occurred. Early heat exchanger equipped barns used wood or coal and eventually many farmers began using oil as it became increasingly expensive. Liquid propane gas was a cheaper and more readily available alternative so most growers converted their barns to use direct-fire burners fueled by propane.

There currently exists a need for unique and innovative tobacco curing processes that can be easily accomplished yet yield dramatic results, including the reduction of nitrosamines as well as the production of high quality tobacco.

SUMMARY OF THE INVENTION

It is accordingly an object to the present invention to provide a method and apparatus for facilitating a tobacco curing process which results in lower nitrosamines in the cured tobacco than with unassisted curing processes.

It is another object of the present invention to provide such an apparatus that is easily constructed from readily available materials.

It is another object of the present invention to provide such a method and apparatus that results in the application of atmospheric air, with or without treatment materials, to be applied to a curing tobacco plant from the inside of the leaf cluster.

It should be noted that while the present method and apparatus are discussed herein described using burley tobacco, are principles, equipment, apparatus and method have application in other air cured tobacco, as well as flue-cured and fire-cured tobacco.

To those ends, an apparatus and method are provided for facilitating a tobacco curing process for use in a tobacco barn, with the tobacco barn having a plurality of internal cross members for supporting tobacco leaves during curing. The apparatus includes a plenum for attachment to a tobacco barn; a device for generating air movement in fluid communication with the plenum for delivering atmospheric air thereto; and a plurality of conduits in fluid communication with the plenum for receiving airflow therefrom, the conduits being formed with a plurality of openings therein to allow air to flow outwardly therefrom, the conduits being configured for disposition within the barn for fluid communication with tobacco in a curing disposition within the barn.

It is preferred that the plenum is formed from a pliant material and is inflatable by the air movement generating device.

The conduits are preferably formed as tubes that are formed from a pliant material, and are inflatable by the air movement generating device. It is preferable that the air movement generating device is a fan.

The conduits are preferably movable between a stowed disposition and a use disposition. The present invention further preferably includes a plurality of attachment members for mounting the conduits within the barn. Preferably, the attachment members are formed as hooks for engagement with support members in a tobacco barn and for simultaneous engagement with the conduits.

The present invention may be used to facilitate the application of treatment materials, particularly liquids and airborne solid particulate in the form of smoke to curing tobacco. To that end, a portion of the plenum is configured as a reservoir for holding tobacco treatment material. Preferably, the tobacco treatment material is a liquid is chosen from the group consisting of aromatics, flavorants, humectants and water. Further, the tobacco treatment material may be heated air. Solar energy may also be used to alter the atmosphere within the plenum. Accordingly, the plenum may be selectively formed from a transparent material, a translucent material or an opaque material.

The apparatus of present invention may be explained in greater detail as an apparatus for facilitating a tobacco curing process for use in a tobacco barn, with the tobacco barn having a plurality of internal cross members for supporting tobacco leaves during curing. The apparatus includes an inflatable plenum for attachment to a tobacco barn; a fan in fluid communication with the plenum for delivering atmospheric air thereinto; and a plurality of conduits in fluid communication with the plenum for receiving airflow therefrom, the conduits being formed from pliant material for at least partial inflation by the fan, and being formed with a plurality of openings therein to allow air to flow outwardly therefrom. The conduits are configured for disposition within the barn for movement between a stowed disposition and a use disposition for fluid communication with tobacco in a curing disposition within the barn.

It is preferred that the present invention further include a plurality of attachment members for mounting the conduits within the barn. Preferably, the attachment members are formed as hooks for engagement with support members in a tobacco barn and for simultaneous engagement with the conduits.

As noted above, a portion of the plenum may be configured as a reservoir for holding tobacco treatment material, which may include aromatics, flavorants, humectants, and water, taken single or in any combination. In addition, the tobacco treatment material may be heated air, which may include any particulate matter, smoke, or both.

Preferably, the plenum is formed either from a transparent material, a translucent material or an opaque material.

The present invention is also directed to a method for facilitating a tobacco curing process utilizing a tobacco barn, with the tobacco barn having a plurality of internal cross members for supporting tobacco leaves during curing. The method includes the steps of:

(a) providing an apparatus for facilitating a tobacco curing process including a plenum for attachment to a tobacco barn; a device for generating air movement in fluid communication with the plenum for delivering atmospheric air thereto; and a plurality of conduits in fluid communication with the plenum for receiving airflow therefrom, the conduits being formed with a plurality of openings therein to allow air to flow outwardly therefrom;

(b) placing tobacco for curing in the barn with at least a portion thereof overlying the at least one of the conduits;

(c) applying atmospheric air to the plenum using the device for generating air movement, thereby directing moving air into the at least one conduit wherein atmospheric air is directed outwardly through the openings and into contact with the tobacco.

Preferably, the step of providing an apparatus for facilitating a tobacco curing process includes providing a plenum wherein a portion of the plenum is configured as a reservoir for holding tobacco treatment material. It is preferred that the method further includes the step of introducing tobacco treatment material into the reservoir. Preferentially, the step of introducing a tobacco treatment material into the reservoir includes introducing a tobacco treatment liquid chosen from the group consisting of aromatics, flavorants and humectants. Further, the step of introducing a tobacco treatment liquid into the reservoir may include introducing water.

Since the conduits of the present invention are easily stowed against the barn walls, the method preferably includes providing an apparatus for facilitating a tobacco curing process wherein the conduits are movable between a stowed disposition and a use disposition, and the method further comprises the step of moving at least one of the conduits from a stowed disposition to a use disposition.

The present method addresses the ability of the present apparatus to utilize solar energy to control the atmosphere within the plenum. To that end, the step of providing an apparatus for facilitating a tobacco curing process includes providing a plenum formed from a transparent material, a translucent material or on opaque material.

The present invention also provides a method for treating tobacco during the curing process with some form of treatment material, usually in liquid or airborne particulate form. To that end, a method for facilitating a tobacco curing process utilizing a tobacco barn, with the tobacco barn having a plurality of internal cross members for supporting tobacco leaves during curing includes the steps of:

(a) providing an apparatus for facilitating a tobacco curing process including a plenum for attachment to a tobacco barn, a portion of the plenum being configured as a reservoir for holding tobacco treatment liquid; a fan in fluid communication with the plenum for delivering atmospheric air thereto; and a plurality of conduits in fluid communication with the plenum for receiving airflow therefrom, the conduits being formed with a plurality of openings therein to allow air to flow outwardly therefrom, the conduits being movable between a stowed disposition and a use disposition;

(b) introducing a tobacco treatment liquid into the reservoir, the tobacco treatment liquid chosen from the group consisting of aromatics, flavorants, humectants and water;

(c) moving at least one of the conduits from a stowed disposition to a use disposition;

(d) placing tobacco for curing in the barn with at least a portion thereof overlying the at least one of the conduits; and (e) applying atmospheric air to the plenum using the device for generating air movement, thereby directing moving air into the at least one conduit wherein atmospheric air is directed outwardly through the openings and into contact with the tobacco.

DESCRIPTION OF THE PREFERRED EMBODIMENTS

The present invention provides an apparatus, the operation of which can be controlled to thereby effect a measure of control over a tobacco curing process which can produce tobacco with reduced nitrosamines. The apparatus may be constructed from commonly found and relatively inexpensive materials.

Figure 1:
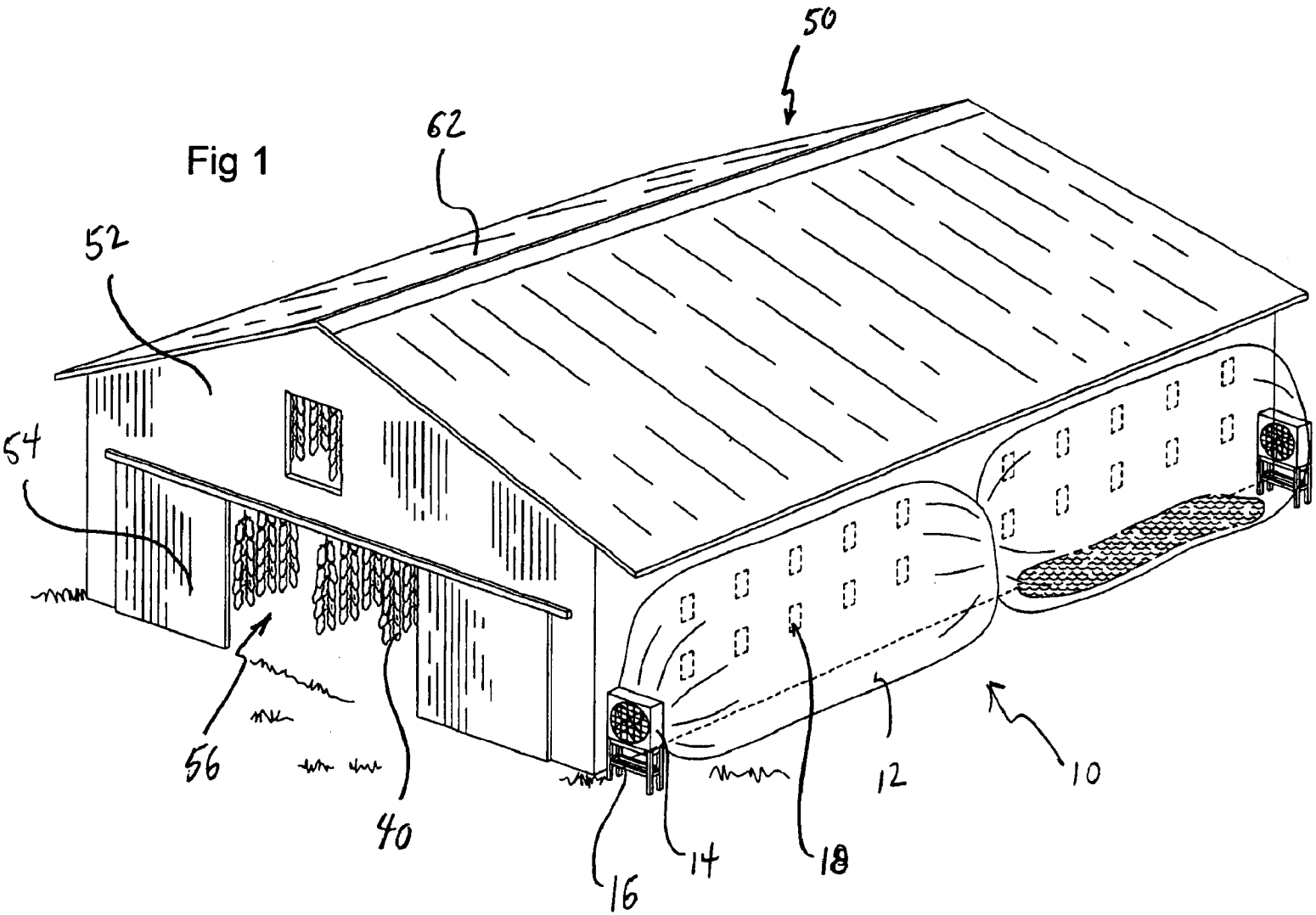
FIG. 1 is a perspective view of a barn equipped with an apparatus for facilitating a tobacco curing process according to one preferred embodiment of the present invention.
Figure 2:
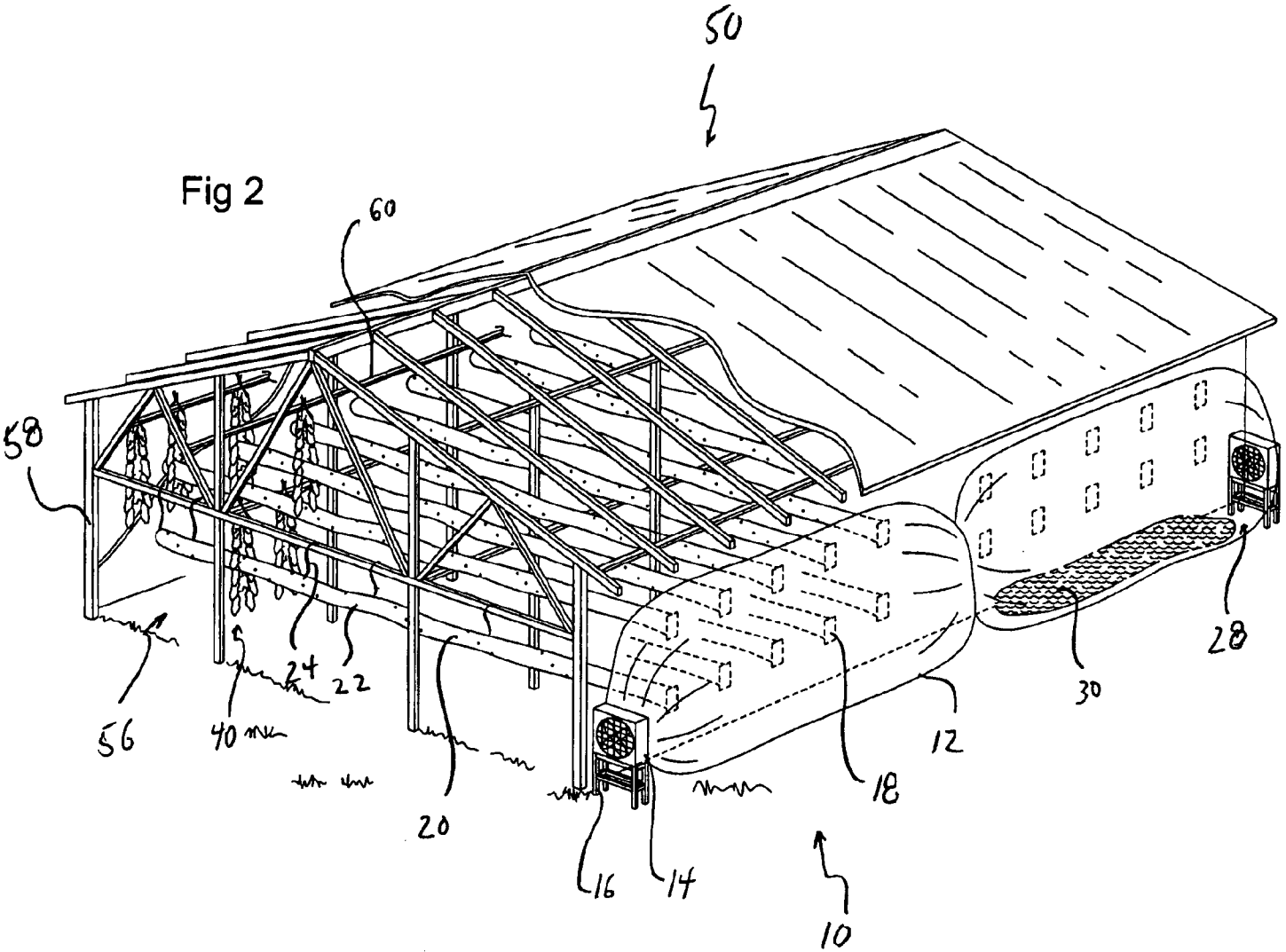
FIG. 2 is a perspective view of the barn of FIG. 1, shown broken open to illustrate the internal structure of the barn in combination with the present apparatus.

Turning now to the drawings and, more particularly to FIG. 1, the environment in which the present apparatus operates and the present method is practiced is illustrated. The environment includes a tobacco barn 50 having an internal skeletal framework 58, which is best seen in FIG. 2. The skeletal framework 58 includes a plurality of upstanding support members cojoined by a plurality of horizontally extending cross members, some of which may function as tobacco support members 60. The skeletal framework 58 is covered with walls 52, and doors 54 provide access to an interior cavity 56 defined by the barn structure. The tobacco barn is essentially a conventional tobacco barn and typically includes ventilation under the eaves of the roof 62.

Figure 3:
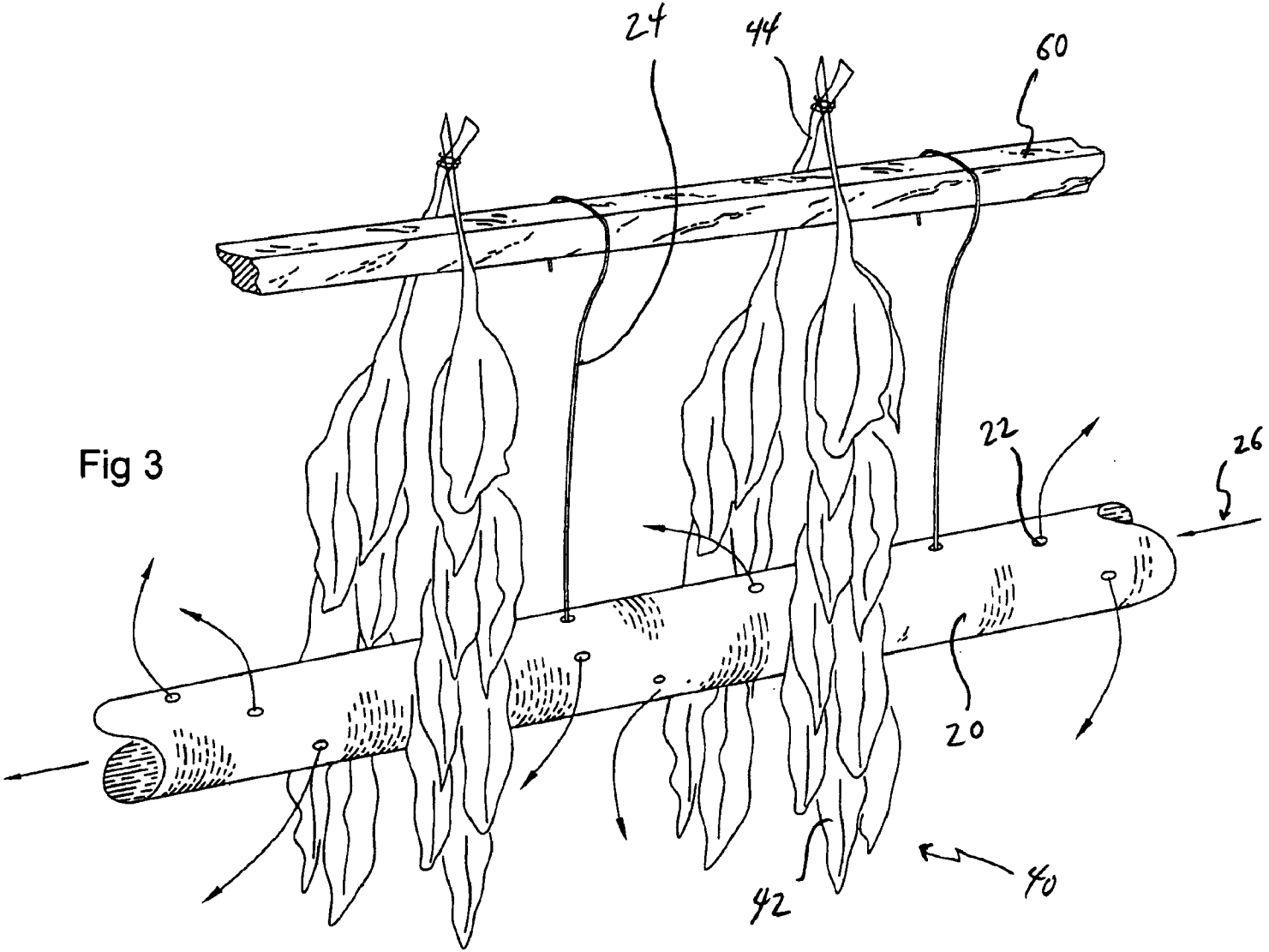
FIG. 3 is a perspective view of a portion of a tobacco support structure illustrating the relationship between curing tobacco and the conduits of the present invention.
Figure 4:
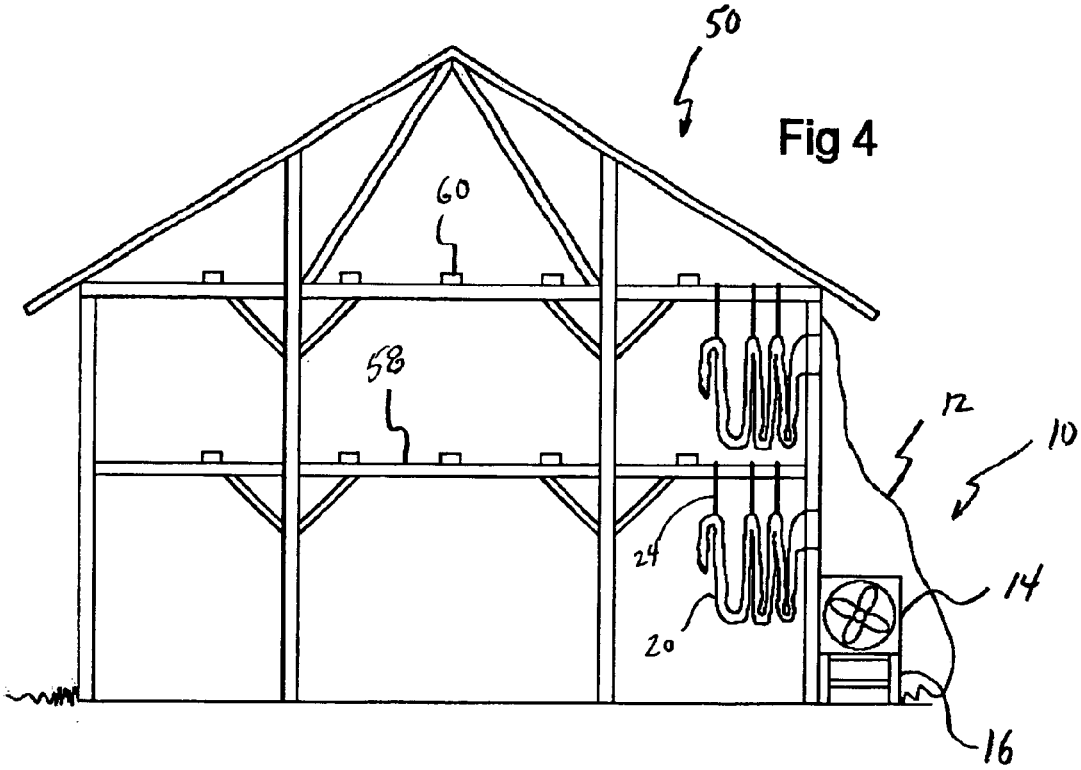
FIG. 4 is an elevational view of a tobacco barn equipped with the apparatus of the present invention, with the conduits in a stowed disposition.

Turning now to FIG. 2, the barn 50 is shown broken open to illustrate the internal construction of the barn 50 and its relationship to the present apparatus 10 as will be explained in greater detail here and after. A portion of FIG. 2 is also used to illustrate the tobacco 40 hanging in the barn 50. It will be understood by those skilled in the art that the barn will typically be filled with tobacco, with leaves and stalks hanging from every tobacco support member 60. As also illustrated in FIG. 3, the tobacco 40 hangs from the tobacco support member 60 where it is typically hung by the stalk 44 so that the leaves 42 hang free in the atmosphere for curing.

With reference to FIGS. 1 and 2, the apparatus of the present invention is illustrated generally at 10 and includes at least one plenum 12 which may be formed from sheet plastic material fixed to one wall 52 of the barn 50. The bag may be formed from transparent, translucent, or opaque material and the choice will depend on the desired air temperature within the plenum 12. As may be expected, solar effects can provide hot air in a dark, opaque bag whereas a light reflective bag would not experience similarly intense solar heat. It is also contemplated that a solar panel may be provided if further heat treatment of the atmosphere within the plenum 12 is desired. The solar panel is not illustrated but one of ordinary skill in this art should be able to apply a solar panel without undue experimentation.

Figure 5:
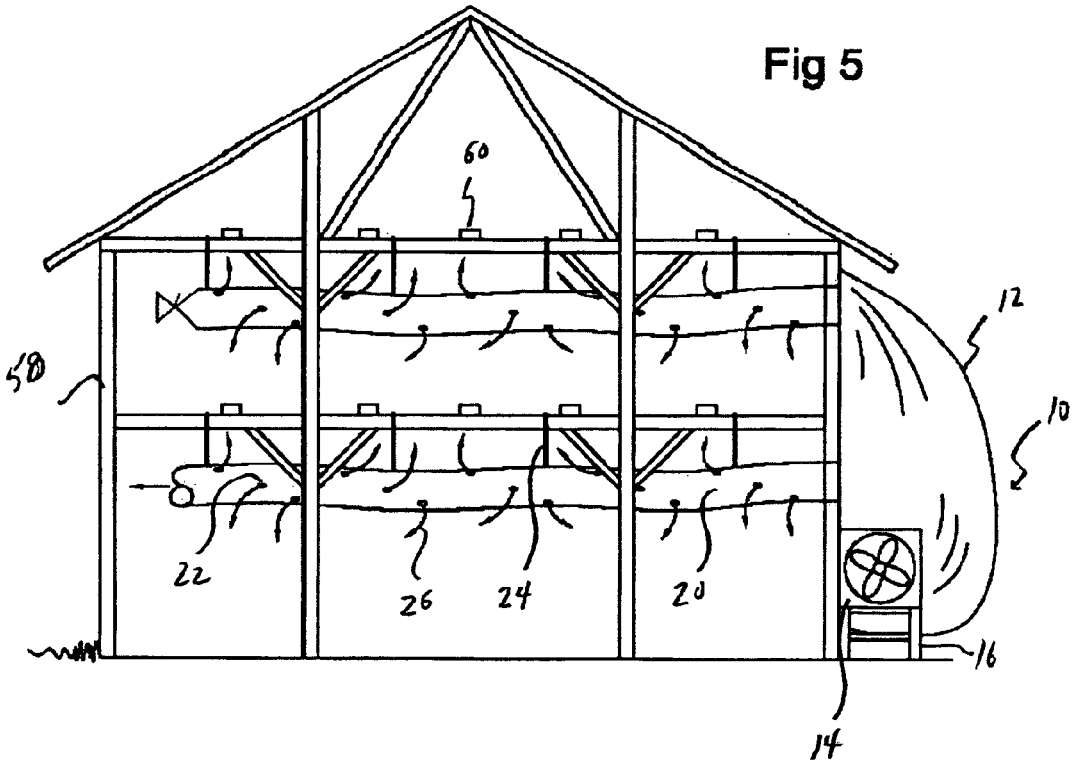
FIG. 5 is an elevational view of a tobacco barn equipped with the apparatus of the present invention, with the conduits in a use disposition.

The present invention also includes a plurality of pliant plastic conduits or tubes 20 for air distribution within the barn 50. The tubes 20 include a plurality of perforations 22 that act as air outlets. The tubes 20 are in fluid communication with the plenum 12 and achieve this communication by outlets 18 formed in the barn wall 52 within the confines of the plenum 12. The tubes 20 are formed from a flaccid plastic material similar to that forming the plenum 12. As seen in FIG. 3, the tubes 20 are suspended from overhead support structures which may be tobacco support members 60 by metal hooks 24 which drape over a support member 60 and engage the tube 20. The tubes 20 may be open at a distal end thereof or they may be tied off at any place along heir length, as seen in FIG. 5 to adjust airflow which may include eliminating airflow from areas that are devoid of tobacco. It should be noted that tobacco maybe suspended from the support members 60 in ways other than as depicted in FIG. 3. For example, the stalks may be split, not tied and a stick may be involved. What is significant is the overlapping of the tubes 20 by the tobacco leaves 42.

Air is forced into the plenum 12 and, subsequently, through the tubes 20 using a fan 14 which may be a conventional box fan. The fan 14 is supported off the ground by a fan support structure 16. The fan support structure 16 may be wood, metal or any combination thereof to fulfill the only requirement of supporting the fan 14 above the ground in a position that allows the fan 14 to feed atmospheric air into the plenum 12. The fan 14, plenum 12, inlets 18, and tubes 20 provide and define an airflow path illustrated by arrows 26 from the atmospheric air outside the barn to air exiting the perforations 22 in the tubes 20. As seen in FIG. 3, the tubes 20 hang below the tobacco support members 60 and the tobacco leaves 42 overly the tubes 20 and, therefore, the airflow path 26 extends outwardly from the tubes 20 and through the tobacco leaves 42 from the inside out. Use of the phrase "from the inside out" refers to the airflow through a cluster of tobacco leaves as a result of action by the present invention. The disposition of the tobacco leaves 42 in a manner that overlies the tubes 20 allows air to flow from inside the leaf cluster to the outside and is important to the enhanced curing process achieved by the apparatus and method of the present invention.

Other options are available with the apparatus 10 of the present invention. With reference to FIG. 2, it can be seen that a lower portion of the plenum 12 may form a treatment reservoir 28 for holding liquid treatment material 30. The treatment material 30 may be an aromatic, flavorant, or a humectant, or water. The choice will depend on the desired outcome of the curing process or how much moisture is desired for the atmosphere within the barn 50. The treatment material is evaporated into the air stream and distributed through the tubes 20 in an airborne manner.

Optionally, a smoke or particulate distribution may occur with the smoke being introduced through the fan 14. This is not illustrated but should be apparent to those skilled in the art.

Additionally, a dual system may be used as illustrated in FIGS. 1 and 2 with a second plenum 12 and a second fan 14 supplying a second set of tubes 20.

In operation, and according to the method of the present invention, the present apparatus 10 may be used to control airflow and the application of moisture or treatment materials based on the atmospheric conditions then prevailing within the barn and can provide a measure of control over the curing process. By slowing and controlling the bacteria growth within the curing tobacco, a substantial reduction of nitrosamines can be achieved with the present apparatus.

The present tubes 20 may be positioned once the tobacco is in place or the tobacco may be hung after the tubes 20 are in place. In either case, and with reference to FIG. 3, the present apparatus is illustrated in a non-operational disposition. In order to utilize the present apparatus, the plurality of tubes 20 are extended widthwise across the barn 50 and are suspended by hooks from the tobacco support members 60.

Once the tubes 20 are unfurled as seen in FIG. 3, the fan 14 may be started which will inflate the plenum 12 and start airflow through the tubes 20 and outwardly through the perforations 22 and among the tobacco leaves 42, moving from inside the leaf cluster outwardly to the surrounding atmosphere.

Once the tubes 20 are extended and any tubes 20 that require tying off are tied off, all that remains is to start the fan 14. The plenum 12 will then fill and air will flow through the tube 20 along the airflow path 26 and outwardly from the inner portions of the tobacco 40.

The apparatus 10 may be operated according to prevailing atmospheric conditions at the fan 14 intake. For example, dry air can be circulated within the apparatus to reduce moisture content. Importantly, by using the present apparatus 10 the dry air can be applied to the leaf 42 from the inside out, thereby reaching portions of the tobacco 40 that might have received little, if any, ventilation otherwise. The result is an increase in curing consistency throughout the tobacco crop. If the tobacco has been hot and dry, the apparatus may be operated on cool, misty mornings to increase the moisture content. Operation essentially involves judgment regarding the state of the crop and an assessment of the weather, prior to activating the fan 14. Control of the fan 14 could be made automatic with temperature and humidity detectors and a computer, or even with only a timer. However, one of the features of the present invention is its low material cost, and it will be realized that if sophisticated computers, instrumentation or both are employed, the cost of the apparatus 10 could be dramatically increased. Nevertheless, those of skill in this art will appreciate that the present invention does not need a sophisticated control system for effectiveness.

As discussed above with relation to the apparatus 10, a treatment material 30 may be introduced into the plenum 12 which then forms a reservoir 28 at the base thereof, provided the treatment material is liquid. Air movement over the treatment liquid will evaporate some of the liquid into the atmosphere and will distribute the treatment material through the tubes 20 and into the curing tobacco 40. This may also be achieved with smoke or particulate matter which is fed inwardly through the fan, thereby filling the plenum and distributing the smoke or particulate matter through the tubes 20 and into the curing tobacco 40.

By the above, the present invention provides a method and apparatus for controlling the atmosphere within a tobacco barn and, more specifically, for directing airflow through clusters of curing tobacco leaves from the inside of the cluster to the outside of the cluster to facilitate the curing process. This achieves lower nitrosamines than have previously been seen with unassisted curing, provides a better tasting, more consistent tobacco product and provides a better return for a tobacco farmer.

Further, the apparatus may be easily made from commonly found materials and is easy to understand, assemble and operate. Therefore, the present invention will not add unduly to the farmer's burden while providing an enhanced tobacco product.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

I claim:

1. An apparatus for facilitating a tobacco curing process for use in a tobacco barn, with the tobacco barn having a plurality of internal cross members for supporting tobacco leaves during curing, said apparatus comprising:

a plenum formed from pliant material for attachment to a tobacco barn;

a device for generating air movement in fluid communication with said plenum for delivering atmospheric air thereto; and a plurality of conduits in fluid communication with said plenum for receiving airflow therefrom, said conduits being formed with a plurality of openings therein to allow air to flow outwardly therefrom, said conduits being configured for disposition within the barn for fluid communication with tobacco in a curing disposition within the barn.

2. An apparatus for facilitating a tobacco curing proms according to claim 1 wherein said plenum is inflatable by said device for generating air movement.

3. An apparatus for facilitating a tobacco curing process according to claim 1 wherein said conduits are formed as tubes that are formed from a pliant material.

4. An apparatus for facilitating a tobacco curing process according to claim 1 wherein said conduits are inflatable by said a device for generating air movement.

5. An apparatus for facilitating a tobacco curing process according to claim 1 wherein said device for generating air movement is a fan.

6. An apparatus for facilitating a tobacco curing process according to claim 1 wherein said conduits are movable between a stowed disposition and a use disposition.

7. An apparatus for facilitating a tobacco curing process according to claim 1 and further comprising a plurality of attachment members for mounting said conduits within the barn.

8. An apparatus for facilitating a tobacco curing process according to claim 7 wherein said attachment members are formed as hooks for engagement with support members in a tobacco barn and for simultaneous engagement with said conduits.

9. An apparatus for facilitating a tobacco curing process according to claim 1 wherein a portion of said plenum is configured as a reservoir for holding tobacco treatment material.

10. An apparatus for facilitating a tobacco curing process according to claim 9 wherein said tobacco treatment material is a liquid is chosen from the group consisting of aromatics, flavorants, humectants and water.

11. An apparatus for facilitating a tobacco curing process according to claim 9 wherein said tobacco treatment material is heated air.

12. An apparatus for facilitating a tobacco curing process according to claim 1 wherein said plenum is formed from a transparent material.

13. An apparatus for facilitating a tobacco curing process according to claim 1 wherein said plenum is formed from a generally translucent material.

14. An apparatus for facilitating a tobacco curing process according to claim 1 wherein said plenum is formed from an opaque material.

15. An apparatus for facilitating a tobacco curing process for use in a tobacco barn, with the tobacco barn having a plurality of internal cross members for supporting tobacco leaves during curing, said apparatus comprising:

an inflatable plenum for attachment to a tobacco barn;

a fan in fluid communication with said plenum for delivering atmospheric air thereinto; and a plurality of conduits in fluid communication with said plenum for receiving airflow therefrom, said conduits being formed from pliant material for at least partial inflation by said fan, and being formed with a plurality of openings therein to allow air to flow outwardly therefrom, said conduits being configured for disposition within the barn for movement between a stowed disposition and a use disposition for fluid communication with tobacco in a curing disposition within the barn.

16. An apparatus for facilitating a tobacco curing process according to claim 15 and further comprising a plurality of attachment members for mounting said conduits within the barn.

17. An apparatus for facilitating a tobacco curing process according to claim 16 wherein said attachment members are formed as hooks for engagement with support members in a tobacco barn and for simultaneous engagement with said conduits.

18. An apparatus for facilitating a tobacco curing process according to claim 15 wherein a portion of said plenum is configured as a reservoir for holding tobacco treatment material.

19. An apparatus for facilitating a tobacco curing process according to claim 18 wherein said tobacco treatment material is chosen from the group consisting of aromatics, flavorant, humectants, and water.

20. An apparatus for facilitating a tobacco curing process according to claim 15 wherein said tobacco treatment material is heated air.

21. An apparatus for facilitating a tobacco curing process according to claim 15 wherein said plenum is formed from a transparent material.

22. An apparatus for facilitating a tobacco curing process according to claim 15 wherein said plenum is formed from a generally translucent material.

23. An apparatus for facilitating a tobacco curing process according to claim 15 where said plenum is formed from an opaque material.

24. A method for facilitating a tobacco curing process for use in a tobacco barn, with the tobacco barn having a plurality of internal cross members for supporting tobacco leaves during curing, said method comprising the steps of:

providing an apparatus for facilitating a tobacco curing process including a plenum formed from pliant material for attachment to a tobacco barn; a device for generating air movement in fluid communication with said plenum for delivering atmospheric air thereto; and a plurality of conduits in fluid communication with said plenum for receiving airflow therefrom; said conduits being formed with a plurality of openings therein to allow air to flow outwardly therefrom;

placing tobacco for curing in the barn with at least a portion thereof overlying said at least one of said conduits;

applying atmospheric air to said plenum using said device for generating air movement, thereby directing moving air into said at least one conduit wherein atmospheric air is directed outwardly through said openings and into contact with said tobacco.

25. A method for facilitating a tobacco curing process according to claim 24 wherein said step of providing an apparatus for facilitating a tobacco curing process includes providing a plenum therein a portion of said plenum is configure as a reservoir for holding tobacco treatment material.

26. A method for facilitating a tobacco curing process according to claim 25 and further comprising the step of introducing tobacco treatment material into said reservoir.

27. A method for facilitating a tobacco curing process according to claim 26 wherein said step of introducing a tobacco treatment material into said reservoir includes introducing a tobacco treatment liquid chosen from the group consisting of aromatics, flavorants and humectants.

28. A method for facilitating a tobacco curing process according to claim 26 wherein said step of introducing a tobacco treatment material into said reservoir includes introducing water.

29. A method for facilitating a tobacco curing process according to claim 24 wherein said step of providing an apparatus for facilitating a tobacco curing process includes providing an apparatus for facilitating a tobacco curing process wherein said conduits are movable between a stowed disposition and a use disposition, and said method further comprises the step of moving at least one of said conduits from a stowed disposition to a use disposition.

30. A method for facilitating a curing process according to claim 24 wherein said step of providing an apparatus for facilitating a tobacco curing process includes providing a plenum formed from generally transparent material.

31. A method for facilitating a tobacco curses process according to claim 24 wherein said step of providing an apparatus for facilitating a tobacco curing process includes providing a plenum formed from a generally translucent material.

32. A method for facilitating a tobacco curing process according to claim 24 wherein said step of providing an apparatus for facilitating a tobacco curing process includes providing a plenum formed form a generally opaque material.

33. A method for facilitating a tobacco curing process for use in a tobacco barn, with the tobacco barn having a plurality of internal cross members for supporting tobacco leaves during curing, said method comprising the steps of:

providing an apparatus for facilitating a tobacco curing process including a plenum for attachment to a tobacco barn, a portion of said plenum being configured as a reservoir for holding tobacco treatment liquid; a fan in fluid communication with said plenum for delivering atmospheric air thereto; and a plurality of conduits in fluid communication with said plenum for receiving airflow therefrom, said conduits being formed with a plurality of openings therein to allow air to flow outwardly therefrom, said conduits being movable between a stowed disposition and a use disposition;

introducing a tobacco treatment liquid into said reservoir, said tobacco treatment liquid chosen from the group consisting of aromatics, flavorants, humectants and water;

moving at least one of said conduits from a stowed disposition to a use disposition;

placing tobacco for curing in the barn with at least a portion thereof overlying said at least one of said conduits;

applying atmospheric air to said plenum using said device for generating air movement, thereby directing moving air into said at least one conduit wherein atmospheric air is directed outwardly through said openings and into contact with said tobacco.

* * * * *